United States Patent [19]

Chan

[11] 4,223,283

[45] Sep. 16, 1980

[54] TWO INTO THREE PORT PHASE SHIFTING POWER DIVIDER

[75] Inventor: Kwok K. Chan, Kirkland, Canada

[73] Assignee: RCA Corporation, New York, N.Y.

[21] Appl. No.: 969,157

[22] Filed: Dec. 13, 1978

[30] Foreign Application Priority Data

Nov. 16, 1978 [CA] Canada ..... 316355

[51] Int. Cl.[2] ..... H01P 5/18; H01P 5/20

[52] U.S. Cl. ..... 333/109; 333/121

[58] Field of Search ..... 333/109, 113–117, 333/121, 122, 125, 127, 128, 136, 137

[56] References Cited

U.S. PATENT DOCUMENTS

| | | | |
|---|---|---|---|
| 3,219,949 | 11/1965 | Heeren | 333/109 |
| 3,678,415 | 7/1972 | Kuroda | 333/128 X |
| 3,988,705 | 10/1976 | Drapac | 333/109 |

*Primary Examiner*—Paul L. Gensler

*Attorney, Agent, or Firm*—Samuel Cohen; Joseph D. Lazar; Robert L. Troike

[57] ABSTRACT

A microwave power divider is formed of a plurality of input ports (one or two pairs) and a plurality of output ports (one or two sets of three) which deliver three properly phased output signals in response to only one input signal at one input port of a pair of ports. A second signal at the second input port of the pair of ports similarly will cause three properly phased output signals to be delivered.

10 Claims, 4 Drawing Figures

TWO INTO THREE PORT PHASE SHIFTING POWER DIVIDER

BACKGROUND OF THE INVENTION

This invention relates to microwave power dividers and more particularly to microwave power dividers having a plurality of input ports and a plurality of output ports wherein the output ports are decoupled from one another.

The microwave antenna reflector of a communications satellite is often driven by three antenna feed horns arrayed in azimuth and staggered in their common aperture plane to provide a beam shaped to match a particular region on the earth such as Canada or the continental United States. The desired beam shape results from the physical location of the antenna feed horns with respect to one another and the proper phase relationship between the set of three driving signals. The phase slope relationship between the phase of the signals driving the antenna feed horns can be either a positive or negative going linear phase slope referred to in the art as an azimuthal linear phase progression.

It is further desirable in the communication satellite art to have signals with a positive linear phase progression applied to the antenna feed horns in response to a signal emanating from what is known in the art as an even numbered repeater channel. Similarly, it is desirable to have signals with a negative going linear phase progression applied to the antenna feed horns in response to a signal emanating from an odd numbered repeater channel. Such an operation is accomplished in the prior art by a two input port into a three output port (viz., "2–3") phase converter which provides three properly phase output signals only when two input signals of equal magnitude but 90° out of phase are applied to the inputs of the phase converter. A prior art patent exemplary of such a 2–3 microwave phase in U.S. Pat. No. 3,843,941, issued to Hudspeth, et al., on Oct. 22, 1974.

In Hudspeth, a +90° phase difference between the input signals produces output signals having a positive phase progression and a −90° phase difference between the input signals produces output signals having a negative phase progression. In the art, this 90° phase difference normally necessitates the use of a 3 db hybrid quadrature junction or coupler unit between the single signal driving source and the two inputs to the phase converter to provide the proper quadrature phase relationship between the input signals to the phase converter.

The present invention provides a power divider which delivers three properly phased output signals in response to only one input signal at one input port. Thus, the present invention eliminates the need for a hybrid quadrature unit to generate the two simultaneously applied input signals in phase quadrature to the power divider. It is to be understood that since only one input need be excited to create a properly phased set of output signals that two different input signals can be applied to the power divider with each input signal being applied to one of the power divider inputs resulting in two different but simultaneous output phase progressions appearing at the power divider output ports.

The present invention also eliminates the need for isolators between the output of the 2–3 microwave power divider and each antenna feed horn. This is because the 2–3 microwave power divider of the present invention provides a greater decoupling between output ports than has otherwise been achievable to date.

DESCRIPTION OF THE PREFERRED EMBODIMENT

Figure 1:
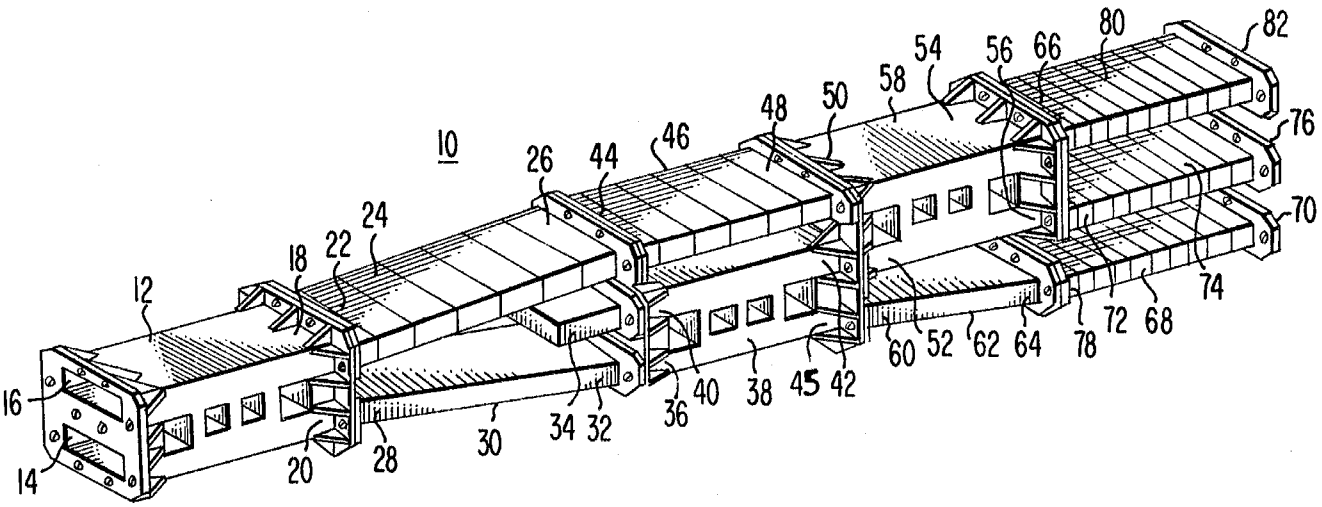
FIG. 1 is a perspective view of a three directional coupler embodiment of a microwave power divider according to the invention.

Referring to FIG. 1, there is shown a two input port, three output port microwave power divider 10 the major components of which will be described in general. More details will be given in the description of FIG. 2 to follow. A suitable three db coupler 12 for attenuation and phase shifting is provided with input ports 14 and 16 each suitable for receiving a microwave signal in, for example, the radar C-band (3.7–4.2 GHz). Couplers are well known in the art. See, for example, an article entitled "Modify Combiner Designs to Team High Power Amps," by A. W. Morse, published in Microwaves, January 1978, page 70 et seq. Within 3 db coupler 12, a first portion of the signal at port 14 is coupled to port 18 and a second portion of the signal at port 14 is coupled to port 20. Also within 3 db coupler 12, a first portion of the signal at input port 16 is coupled to output port 20 and a second portion of the signal at input port 16 is coupled to output port 18.

Output port 18 of coupler 12 is coupled to input port 22 of a suitable phase equalizer 24 which is coupled in turn by its output port 26 to input port 44 of phase equalizer 46. Output port 20 of coupler 12 is coupled to input port 28 of waveguide section 30 which is coupled in turn by its output port 32 to input port 36 of a 4.77 db coupler 38. A resistive terminating load 34 is coupled to input port 40 of the coupler 38. Within coupler 38, a first portion of the signal from input port 36 is coupled to output port 45 and a second portion of the signal at input port 36 is coupled to output port 42.

Output port 48 of phase equalizer 46 is coupled to input port 50 of a suitable 3 db coupler 58 and output port 42 of coupler 38 is coupled to input port 52 of the coupler 58. Within the coupler 58, a first portion of the signal at input port 52 is coupled to output port 56 and a second portion of the signal at input port 52 is coupled to output port 54. Also within the coupler 58, a first portion of the signal at input port 50 is coupled to output port 56 and a second portion of the signal at input port 50 is coupled to output port 54.

Output port 44 of the coupler 38 is coupled to input port 60 of a waveguide section 62 which is coupled by its output port 64 to input port 78 of a suitable multi-section multi-iris capactively loaded −45° phase shifter 68. Output ports 56 and 54 of the coupler 58 are coupled to the input port 72 of a multi-section multi-iris inductively loaded +45° phase shifter 74 and the input port 66 of a multi-section multi-iris capactively loaded −45° phase shifter 80, respectively. Phase shifters 68, 74, and 80 have output ports 70, 76, and 82, respectively. It is to be understood that the three desired output signals of microwave power divider 10 will appear at output ports 70, 76, and 82.

Figure 2:
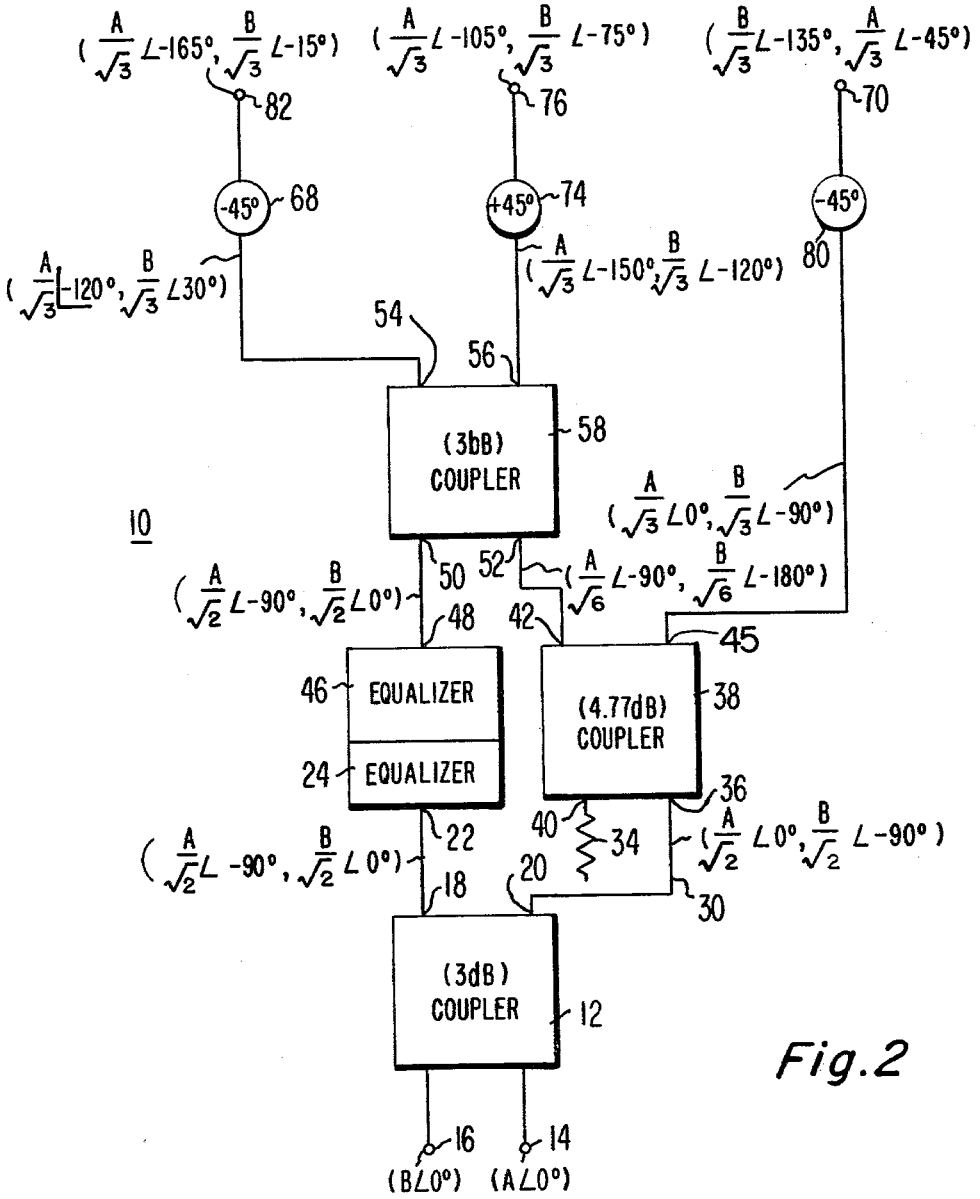
FIG. 2 is a schematic block diagram of the three directional coupler embodiment of the two into three way microwave power divider shown in FIG. 1.

Referring now to FIG. 2, there is shown a schematic block diagram of the three directional coupler embodiment of microwave power divider 10. In order to demonstrate the operation of microwave power divider 10 and to simplify the discussion, co-phased (in-phase) input signals will be used as shown in FIG. 2. It is to be understood that in actual operation the two input signals will not normally be co-phased.

Furthermore, the two signals are typically at respectively different frequencies.

It is to be further understood that the power divider may be used with either one or two input signals applied to either one or both of the input ports, respectively. Further, there is no need in the practice of the invention that there be any phase or amplitude relationship between the two input signals.

Input microwave signals A/0° and B/0° are applied in phase to input ports 14 and 16 of 3 db coupler 12, respectively, as indicated in FIG. 2. It should be understood that, for the purpose of this description, the symbols "$A\angle\theta$°" means a signal having a magnitude "A" at an angle of $\theta$ degrees. Input signal $A\angle 0°$ at input port 14 is attenuated by 3 db and phase shifted and appears at output ports 20 and 18 of 3 db coupler 12, as in phase signal $A/\sqrt{2}\angle 0°$ and $-90°$ phase shifted signal $A/\sqrt{2}\angle -90°$, respectively. Similarly, input signal $B\angle 0°$ at input port 16 is attenuated by 3 db and phase shifted and appears at output ports 18 and 20 of 3 db coupler 12 as in phase signal $B/\sqrt{2}\angle 0°$ and as $-90°$ phase shifted signal $B/\sqrt{2}\angle -90°$, respectively.

The two signals, $B/\sqrt{2}\angle 0°$ and $A/\sqrt{2}\angle -90°$ at output port 18 of 3 db coupler 12 pass through serial phase equalizers 24 and 46 which serve to compensate for the small additional phase shift introduced by the transmission of the signals through the 4.77 db coupler 38. Signal $B/\sqrt{2}\angle -90°$ at output port 20 of 3 db coupler 12 is coupled to input port 36 of 4.77 db coupler 38 wherein it is attenuated by 4.77 db and phase shifted and appears at outputs 44 and 42 as signals $B/\sqrt{3}\angle -90°$ and $B/\sqrt{6}\angle -180°$, respectively. Similarly, signal $A/\sqrt{2}\angle 0°$ at output port 20 of 3 db coupler 12 is coupled to input port 36 of 4.77 db coupler 38 wherein it is attenuated by 4.77 db and phase shifted and appears at output ports 45 and 42 as signals $A/\sqrt{3}\angle 0°$ and $A/\sqrt{6}\angle -90°$, respectively.

The signals from phase equalizer 46 and the signals from coupler 38 are coupled to input ports 50 and 52, respectively, of 3 db coupler 58. Within coupler 58, signal $B/\sqrt{2}\angle 0°$ at input port 50 and signal $B/\sqrt{6}\angle -180°$ at input port 52 are attenuated by 3 db, combined and phase shifted and appear as phase shifted signals $B/\sqrt{3}\angle 30°$ and $B/\sqrt{3}\angle -120°$ at output ports 54 and 56, respectively. Also within coupler 58, signal $A/\sqrt{2}\angle -90°$ at input port 50 and signal $A/\sqrt{6}\angle -90°$ at input port 52 are attenuated by 3 db combined and phase shifted and appear as phase shifted signals $A/\sqrt{3}\angle -120°$ and $A/\sqrt{3}\angle -150°$ at output ports 54 and 56, respectively.

The signals at output port 54 of coupler 58 pass through capacitively loaded $-45°$ phase shifter 68 and appear as phase retarded signals $A/\sqrt{3}\angle -165°$ and $B/\sqrt{3}\angle -15°$, respectively, at output port 82 of the power divider 10. The signals at output port 56 of coupler 58 pass through inductively loaded $+45°$ phase shifter 74 and appear as phase advanced signals $A/\sqrt{3}\angle -105°$ and $B/\sqrt{3}\angle -75°$, respectively, at output port 76 of the power divider 10. The signals at output port 45 of coupler 38 pass through capacitively loaded $-45°$ phase shifter 80 and appear as phase retarded signals $A/\sqrt{3}\angle -45°$ and $B/\sqrt{3}\angle -135°$, respectively, at output port 70 of the power divider 10.

It is to be noted that the net effect of power divider 10 is to produce a set of three output signals, a respective one of which appearing at one of the three output ports of the power divider, from each of two input signals. Thus, two input signals (A, B) produce six output signals comprised of a set of three A signals and a set of three B signals, each set having a desired phase relationship. Furthermore, an input signal at either of the input ports to the microwave power divider is effective to produce an output signal at each of the three output ports with a linear phase slope relationship between the output signals. The magnitude of the linear phase slope appearing across the output ports will be independent of which input port is excited by the input signal. Between the phases of the three output signals in a set (A signal or B signal), the linear phase slope will be positive or negative going depending on which of the two input ports is excited by the input signal.

It is, therefore, to be noted, that an input signal applied to input port 14 of power divider 10 will produce output signals at output ports 82, 76, and 70 having relative phases of $-60°$, $0°$, $+60°$, respectively, with respect to the phase of the output signal at output port 76. Note, in FIG. 2, that the actual phases of the A signals at ports 82, 76, and 70 are $-165°$, $-105°$, and $-45°$, which are thus relatively phased as just described. Similarly, an input signal applied to input port 16 of power divider 10 will produce output signals at output ports 82, 76, and 70 having relative phases (to the signal phase at port 76) of $60°$, $0°$, $-60°$, respectively. Thus, the two different phase slopes developed across the output ports in response to an input signal at one of the input ports are equal in magnitude but opposite in slope. Since power divider 10 can produce the two sets at output signals each having a different phase slope relationship simultaneously, it may be referred to as a dual-mode power divider.

Figure 3:
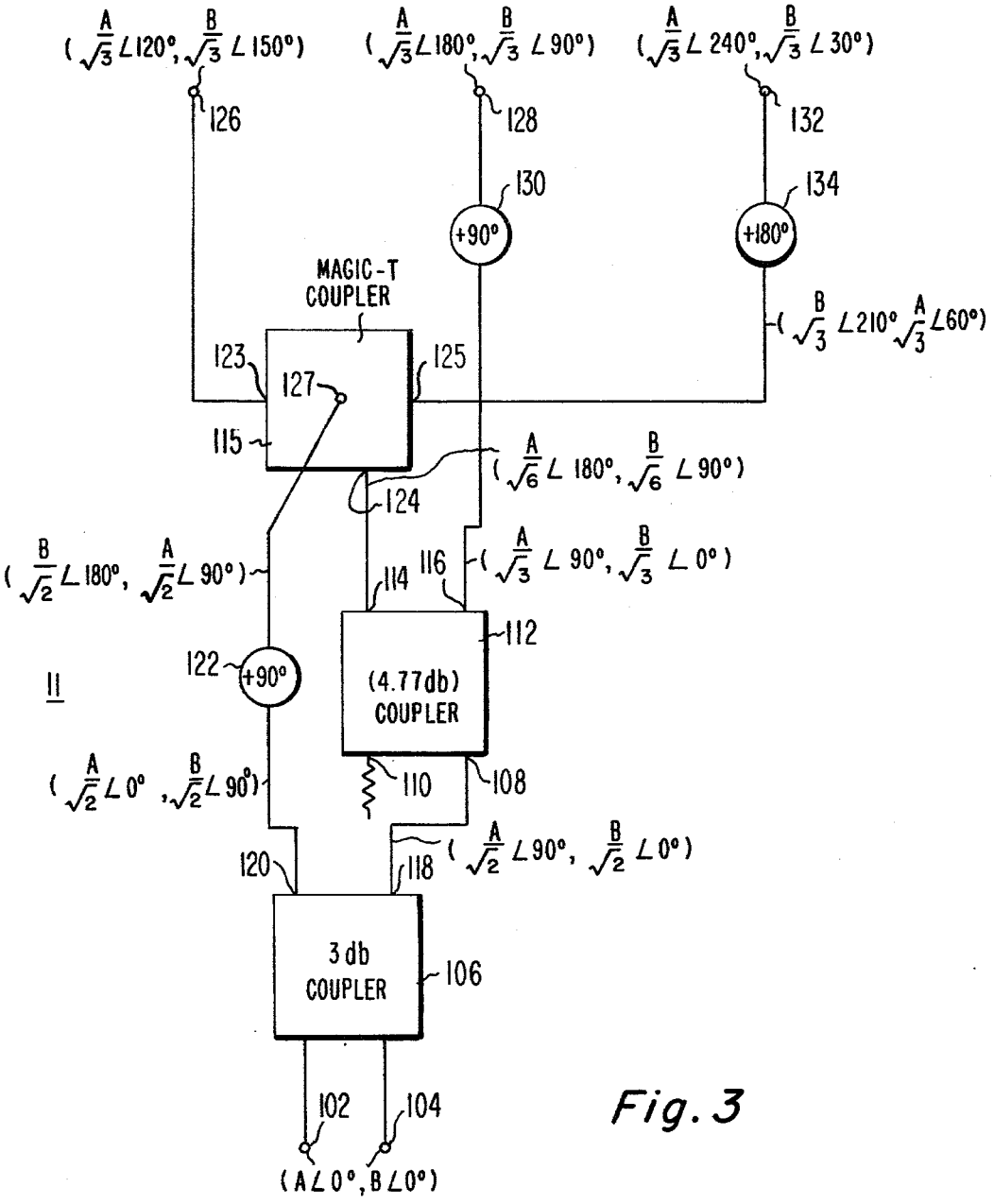
FIG. 3 is a schematic block diagram of another embodiment of the invention using two directional couplers and a Magic-T coupler.

Referring now to FIG. 3, there is shown a schematic block diagram of microwave power divider 11 which is an embodiment of the invention comprising two directional couplers and a Magic-T coupler. Input microwave signals $A\angle 0°$ and $B\angle 0°$ are applied to input ports 102 and 104, respectively, of 3 db coupler 106 wherein they are attenuated and phase shifted and appear at output port 120 as $A/\sqrt{2}\angle 0°$ and $B/\sqrt{2}\angle 90°$, respectively, and at output port 118 as $A/\sqrt{2}\angle 90°$ and $B/\sqrt{2}\angle 0°$, respectively.

The signals at the output port 118 of coupler 106 are applied to input port 108 of a 4.77 db coupler 112 wherein they are attenuated and phase shifted and appear at output port 114 as $A/\sqrt{6}\angle 180°$ and $B/\sqrt{6}\angle 90°$, respectively, and at output port 116 as $A/\sqrt{3}\angle 90°$ and $B/\sqrt{3}\angle 0°$, respectively. The signals from output port 116 of coupler 112 are advanced 90° in phase by phase shifter 130 and appear at output port 128 of microwave power divider 11 as $A/\sqrt{3}\angle 180°$ and $B/\sqrt{3}\angle 90°$.

The signals from output port 120 of coupler 106 are advanced 90° in phase by phase shifter 122 and applied thence to input port 127 of a terminal 4-terminal or port Magic-T coupler 115. The signals from output port 114 of coupler 112 are applied to input port 124 of 4-port Magic-T 115. In response to the signals at input ports 124 and 127, the Magic-T coupler 115 produces signals $A/\sqrt{3}\angle 120°$ and $B/\sqrt{3}\angle 150°$ at Magic-T output port 123 and $A/\sqrt{3}\angle 60°$ and $B/\sqrt{3}\angle 210°$ at Magic-T output port 125.

The signals at output port 123 of coupler 115 are coupled to output port 126 of microwave power divider 11. The signals at output port 125 of coupler 115 are advanced 180° in phase by phase shifter 134 and appear at output port 132 of microwave power divider 11 as signals $A/\sqrt{3}\angle 240°$ and $B/\sqrt{3}\angle 30°$. Similar to microwave power divider 10 (FIGS. 1 and 2), the microwave power divider 11 (FIG. 3) produces two sets of attenuated output signals. The phases of the output signals in each set are related according to a linear phase slope with 60° between each output signal. It is to be noted that the slope of one set of output signals is equal in magnitude but opposite in direction from the other set of output signals. It is to be further noted that a set of output signals is produced at the output ports of microwave power divider 11 when an input signal is applied to either input port. If input signals are applied to each of the two input ports, both sets of output signals will be produced at the output ports of microwave power divider 11.

Figure 4:
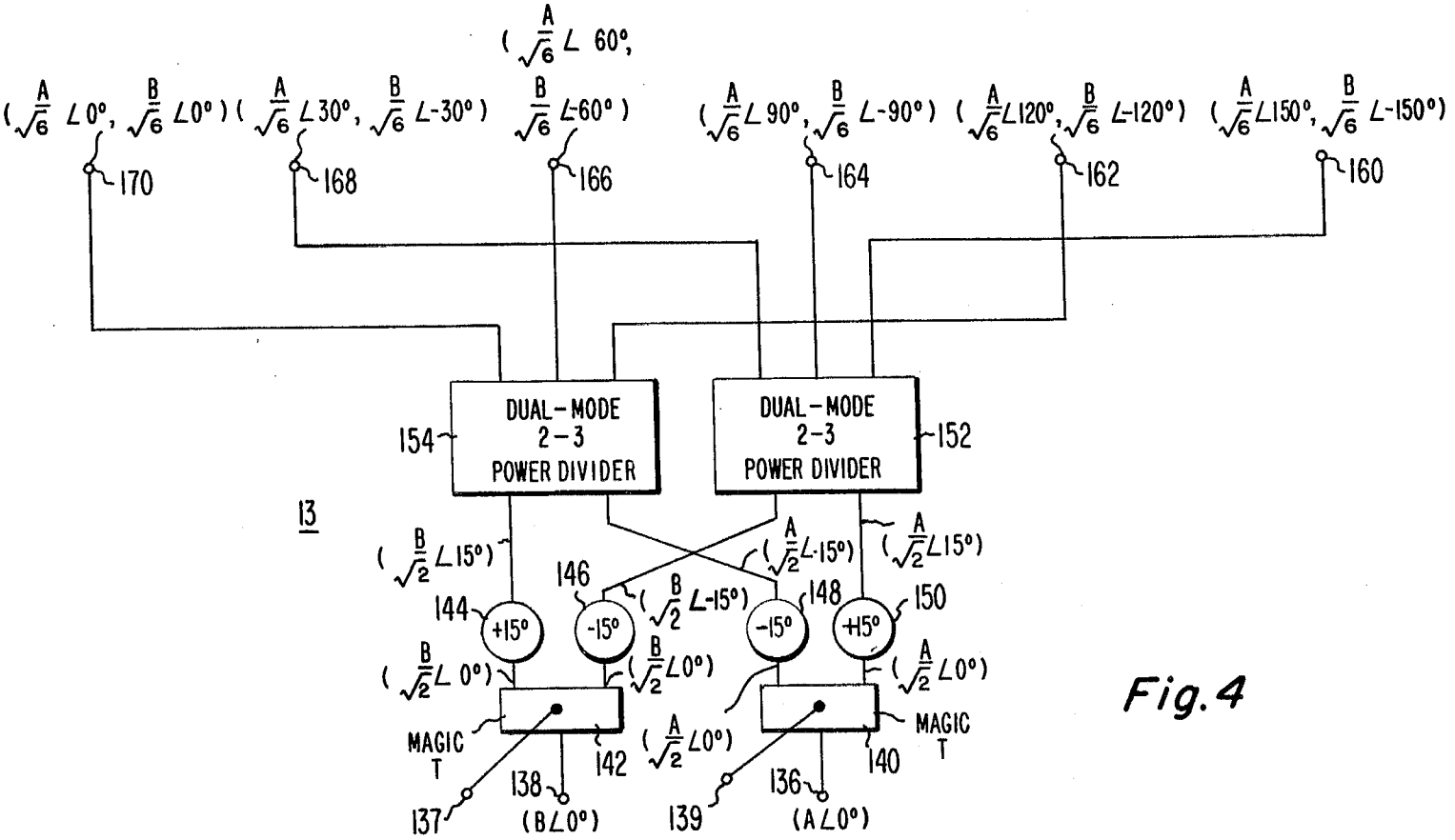
FIG. 4 is a schematic block diagram of a two into six way microwave power divider formed by a pair of two into three way microwave power dividers.

Referring now to FIG. 4, there is shown a dual mode 2–6 microwave power divider 13 formed by a pair of 2–3 microwave power dividers 152 and 154. Microwave power divider 13 develops two sets of output signals, each containing six output signals having a linear phase slope relationship with a phase difference of 30° between each output signal. A signal applied to input port 136 produces a set of output signals having an equal but opposite phase slope from the set of output signals produced when a signal is applied to input port 138.

Input signals $A\angle 0°$ and $B\angle 0°$ at input ports 136 and 138, respectively, are applied to 4-port Magic-T in-phase power dividers 140 and 142, respectively, which divide each of the input signals $A\angle 0°$ and $B\angle 0°$ into two signals attenuated by a factor of $1/\sqrt{2}$ without phase shifting. The phase shifting ports 137 and 139 of couplers 142 and 140, respectively, are not used, as shown in FIG. 4. The four in-phase but attenuated signals are applied to phase shifters 144, 146, 148, and 150 as indicated in FIG. 4. As further indicated in FIG. 4, the signals are phase shifted by +15° or −15° and are applied to the 2–3 power dividers 152 and 154, each producing a set of output signals across the six output ports 160, 162, 164, 166, 168, and 170 in the manner described hereinabove. Each set of output signals has a linear phase slope relationship between the phases of the output signals. Each output signal in a set is shifted by 30° (six signals phase over the desired phase range of 180°) from output signals at adjacent output ports and each output signal is attenuated by a factor of $1/\sqrt{6}$ from the magnitude of the input signal. An input signal at input port 136 produces a set of output signals equal in magnitude but opposite in phase slope from the set of output signals produced when an input signal is applied to input port 138. It is to be understood that either 2–3 microwave power divider 10 or 11 shown in FIG. 2 or 3, respectively, can be used for each of the pair of microwave power dividers 152 and 154 used in the 2–6 microwave power divider shown in FIG. 4.

What is claimed is:

1. A microwave network comprising in combination:

first 3 dB coupler means adapted to receive at least one input signal for producing first and second phase shifted signals;

second 4.77 dB coupler means coupled to said first coupler means for receiving said first phase shifted signals and producing a third phase shifted signal and a first output signal at a power level approximately one third that of the input signal and third coupler means coupled to said first and second coupler means for receving said second and third phase shifted signals and producing second and third output signals at approximately the same power level as said first output signal.

2. The microwave network of claim 1 wherein said third coupler means is coupled to said first coupler means through phase equalizer means for compensating for the phase delay between the second phase shifted signal and the third phase shifted signal.

3. The microwave network of claim 2 wherein said second coupler means is coupled to a first phase shifter to phase shift the first output signal.

4. The microwave network of claim 3 wherein said third coupler means is coupled to a second and third phase shifter means in order to phase shift said second and third output signals, respectively.

5. A microwave network according to claim 1 comprising a second group of said first, second, and third coupler means, and further including at least one Magic-T coupler means, said Magic-T coupler means having one input port and two output ports, a phase shifter connected to each of said Magic-T output ports; said input port adapted to receive said one input signal and phase shifters being respectively connected to said first coupler means and said second group first coupler means to couple said one input signal to the respective first coupler means;

whereby one set of six output signals are provided at the output of said networks.

6. The microwave network of claim 1, wherein said third coupler means comprises a Magic-T network.

7. The microwave network of claim 1, wherein said third coupler means comprises a 3 dB coupler.

8. A three-way power divider comprising:

first, second and third power divider output terminals;

a first coupler having a first coupling ratio and having two inputs for receiving two signals, respectively, whose power is to be divided, and producing at each of first and second output terminals, a given fractional part of both input signals, the fractional part of each signal at the first output terminal being phase displaced from the second fractional part of the same signal at the second output terminal;

a second coupler having a second coupling ratio, different from said first coupling ratio, and having two inputs, connected at one of its input to the first of said output terminals and at its other input to a terminating impedance, said second coupler having first and second output terminals, the first connected to the first power divider output terminal; and a third coupler having two inputs, one connected to the second output terminal of the second coupler, and the other coupled to the second output terminal of the first coupler, said third coupler having first and second output terminals connected to the second and third power divider output terminals, respectively.

9. A three-way divider as set forth in claim 8 wherein the first and third couplers comprises 3 dB couplers and the second coupler comprises a 4.77 dB coupler.

10. A three-way power divider as set forth in claim 8 wherein said first coupler comprises a 3 dB coupler, the second coupler comprises a 4.77 dB coupler, and the third coupler comprises a Magic-T coupler, and further including a 90° phase shifter for coupling the second output terminal of the first coupler to an input to the Magic-T coupler.

* * * * *

UNITED STATES PATENT AND TRADEMARK OFFICE
CERTIFICATE OF CORRECTION

PATENT NO. : 4,223,283

DATED : September 16, 1980

INVENTOR(S) : Kwok K. Chan

It is certified that error appears in the above-identified patent and that said Letters Patent is hereby corrected as shown below:

Column 3, line 21, "A/0° and B/0°" should be --A/0° and B/0°--;

column 6, line 10, "receving" should be --receiving--;

Column 6, line 56, "input" should be --inputs--;

Signed and Sealed this

*Thirteenth* Day of *January 1981*

[SEAL]

*Attest:*

SIDNEY A. DIAMOND

*Attesting Officer*

*Commissioner of Patents and Trademarks*